US009446441B2

(12) United States Patent
Adomavicius

(10) Patent No.: US 9,446,441 B2
(45) Date of Patent: Sep. 20, 2016

(54) TOOL DESIGNED FOR RESTORATION/REPAIR OF FORMWORK PROPS, AND ITS USAGE

(76) Inventor: Linas Adomavicius, Panevezys (LT)

( * ) Notice: Subject to any disclaimer, the term of this patent is extended or adjusted under 35 U.S.C. 154(b) by 540 days.

(21) Appl. No.: 13/816,780

(22) PCT Filed: Jun. 21, 2011

(86) PCT No.: PCT/IB2011/052709

§ 371 (c)(1),
(2), (4) Date: Apr. 11, 2013

(87) PCT Pub. No.: WO2012/023060

PCT Pub. Date: Feb. 23, 2012

(65) Prior Publication Data

US 2013/0205853 A1 Aug. 15, 2013

(30) Foreign Application Priority Data

Aug. 16, 2010 (LT) ..... 2010 058

(51) Int. Cl.
*B21D 1/08* (2006.01)
*B21D 3/16* (2006.01)
(Continued)

(52) U.S. Cl.
CPC . *B21D 3/16* (2013.01); *B21D 1/06* (2013.01); *B21D 1/08* (2013.01); *E04G 19/00* (2013.01); *B21D 39/203* (2013.01)

(58) Field of Classification Search
CPC ..... E04G 19/00; B21D 39/08; B21D 39/10; B21D 39/20; B21D 39/203; B21D 41/021; B21D 41/026; B21D 41/028; B21D 1/08; B21D 3/14; B21D 1/06; B21D 3/16
USPC ..... 72/393
See application file for complete search history.

(56) References Cited

U.S. PATENT DOCUMENTS 183,241 A * 10/1876 Work ..... 72/393
641,646 A * 1/1900 Parker ..... B21D 1/14 42/78

(Continued)

FOREIGN PATENT DOCUMENTS

CH 665573 A5 5/1988
CN 2168912 Y 6/1996

(Continued)

OTHER PUBLICATIONS

English language Abstract for FR 2924143 A1.

(Continued)

*Primary Examiner* — Edward Tolan
(74) *Attorney, Agent, or Firm* — Hershkovitz & Associates, PLLC; Abe Hershkovitz

(57) ABSTRACT

The aim of this invention is easy to use, practical, light, compact, mobile tool, designed for restoration of the formwork props. This tool very effectively removes uneven places and dents present inside the formwork prop without the need for electric power. No special premises or sites are needed for restoration of the formwork props. The tool is very compact and easily packed into a case-shaped box. When performing formwork prop restoration works, no special physical power of a person is necessary. All of the previously mentioned characteristics are ensured by the special design of this tool, where one ending is inlet into the damaged formwork prop close to the place, which is to be repaired, while the other ending, when using the screwdriver, is rotated around its axis. This rotary motion in one ending of the tool pulls the wedge, which is in the other ending of the tool, and, in this way, it spreads the plates, which touch the walls of the formwork prop, and evens them.

20 Claims, 2 Drawing Sheets

(51) Int. Cl.

| | |
|---|---|
| ***B21D 1/06*** | (2006.01) |
| ***E04G 19/00*** | (2006.01) |
| *B21D 39/20* | (2006.01) |

(56) References Cited

U.S. PATENT DOCUMENTS

| | | | | | |
|---|---|---|---|---|---|
| 803,959 | A | * | 11/1905 | Allen | 72/393 |
| 2,085,057 | A | | 6/1937 | Williams | |
| 2,226,078 | A | | 12/1940 | Spahn | |
| 2,298,703 | A | * | 10/1942 | Key et al. | 72/119 |
| 2,423,458 | A | | 7/1947 | Martin | |
| 2,481,628 | A | * | 9/1949 | Sherman | 72/393 |
| 2,620,012 | A | * | 12/1952 | Walsh | B21D 1/08 72/392 |
| 2,687,763 | A | * | 8/1954 | Perkins | B21D 1/08 72/392 |
| 2,704,104 | A | * | 3/1955 | Mueller | 72/31.06 |
| 2,737,996 | A | * | 3/1956 | Toth | 29/243.518 |
| 3,077,916 | A | * | 2/1963 | Vaughn | 72/393 |
| 3,228,224 | A | * | 1/1966 | Anderson | 72/123 |
| 3,829,948 | A | * | 8/1974 | Miller et al. | 29/727 |
| 3,986,383 | A | * | 10/1976 | Petteys | 72/393 |
| 4,253,324 | A | * | 3/1981 | Nugent | 72/393 |
| 4,685,662 | A | * | 8/1987 | Vaughn | 269/43 |
| 4,831,702 | A | * | 5/1989 | Vossbrinck et al. | B23P 19/025 29/426.4 |
| 8,511,133 | B1 | * | 8/2013 | Chen | 72/393 |

FOREIGN PATENT DOCUMENTS

| | | | | | |
|---|---|---|---|---|---|
| DE | 102007034140 | A1 | | 6/2008 | |
| EP | 0530413 | A1 | * | 3/1993 | B21D 39/08 |
| FR | 2924143 | A1 | | 5/2009 | |
| GB | 562970 | A | * | 7/1944 | B21D 39/203 |
| GB | 639103 | A | * | 6/1950 | B21D 29/203 |
| JP | H0498315 | U | | 8/1992 | |
| LV | 12774 | B | | 3/2002 | |
| RU | 2372549 | C2 | | 11/2009 | |

OTHER PUBLICATIONS

English language Abstract for CN 2168912 Y.
English language Abstract for RU 2372549 C2.
English language Abstract for DE 102007034140 A1.
English language Abstract for LV 12774 B.
English language Abstract for CH 665573 A5.
International Search Report mailed on Oct. 25, 2011.

* cited by examiner

TOOL DESIGNED FOR RESTORATION/REPAIR OF FORMWORK PROPS, AND ITS USAGE

FIELD OF THE INVENTION

This invention pertains to a field of construction tools, especially to the tools designed for internal restoration or repair of the construction supports (formwork props), i.e. restoration and repair of their inner local dents, which can coincidentally appear during the usage, transportation or storage of the formwork props.

BACKGROUND OF THE INVENTION

Construction is one of the oldest fields of activities, during which auxiliary constructions are normally used, which facilitate the main process of construction. Some time ago, the function of these auxiliary constructions was performed by wooden constructions, while nowadays, in case of especially high buildings, the function of auxiliary constructions is performed by the construction supports (so called formwork props). These formwork props have one important drawback: if they are at least a little bit coincidentally dented or locally deformed, they become inappropriate and normally are thrown away, because their restoration is not easy. Practically, there are no effective, light and mobile tools, designed for restoration of the formwork props of this type.

There is one known French patent No. FR2924143, published on May 29 of 2009. This patent describes formwork prop, which at the endings is strengthened with additional elements, having the same form as the mentioned formwork prop. These elements protect the formwork prop from impact and from external dents in those places, to which the mentioned additional elements are mounted. However, this is only preventive protection of the formwork props, which protects the formwork props only close to their endings, but does not ensure protection in the whole area of the formwork prop and does not solve the issue of the formwork prop repair/restoration, when the formwork prop is already damaged.

There is another known Chinese patent No. CN2168912, published on Jun. 15 of 1996. This patent describes a device designed for straightening construction supports (formwork props) that are made of steel. This device consists of a special table, onto which the formwork prop is laid, and an engine mechanism, which, when using rails arranged in line one after another, moves the mentioned support over the entire length of the device and, in this way, straightens the formwork prop. The structure itself is simple; however, it is fairly large. It requires separately intended and prepared space. Electric energy is also needed for operation/supply of this equipment. Another drawback is that this system can straighten the formwork props only from the outside and not from the inside.

Another known patent is Russian patent No. RU2372549, published on Nov. 10 of 2009. This patent describes a device, which is inlet into the pipe, able to check the cleanliness level, as well as, by using the compressed air or water under pressure, clean the inner area of the indicated part of the pipe wall. This device is practical, when sand, mud or other undesirable materials get into the formwork prop, however, this device is not suitable for straightening the formwork prop from the inside, because compressed air and water pressure is not enough for performing these works. Moreover, compressor, water or air supply system is required.

There is one more known German patent No. DE102007034140, published on Jun. 5 of 2008. This patent describes a cone-shaped device, with the rotating head, made of diamond or other hard material, which can rotate around its axis. This rotating head is inlet into a pipe or pipe-shaped structure and, in this way, it can clean the inner walls of the pipe-shaped structures from dirt and blockage. Furthermore, it can lengthen and restore minor dents, directed to the inside, of the pipe-shaped structures. However, this system uses electric energy, rotating parts requite special caution, and it is possible to remove only very small dents.

The closest patent according to the prior art is Latvian patent No. LV12774, published on Mar. 20 of 2002. This patent describes hydraulic structure designed for removing the holes or cracks of the formwork props. When using a hydraulic piston, this structure is inlet into the formwork prop and moved along the inner wall of the formwork prop. The mentioned structure has a sealing gasket, which, when the structure is moving from one ending to another, gets and distributes in all holes and cracks of the formwork prop. However, this structure does not foresee the inner local geometry correction of the formwork props, for example, caves, dents and etc.

SUMMARY OF THE INVENTION

The aim of this invention is to design easy to use, light, compact, mobile device for simple technological operations, which is intended for restoration of the formwork props.

The essential feature of this invention is that this tool

- very effectively straightens uneven places or dents of the formwork prop, emerged in the formwork prop during its usage, transportation or storage;
- does not require additional energy, i.e. is completely mechanical;
- does not require any (specially arranged) premises or sites during restoration of the formwork props, i.e. can be used in any place, where the formwork prop can be laid or hung;
- is very compact, easily packed into a case-shaped box;
- does not require special physical power during restoration works of the formwork prop.

All mentioned features for this tool are ensured by a special structure (construction), one ending of which is inlet into the damaged formwork prop in the place, which it is to be repaired, and the other ending, by using a screwdriver, is rotated around its axis. This rotary motion of the screwdriver in one ending of the tool pulls the wedge, present in the other ending of the tool, and, in this way, spreads the plates, which touch the formwork prop walls, i.e. inner uneven places and dents, as well as presses them and returns the formwork prop walls to the initial position.

DESCRIPTION OF THE PREFERRED EMBODIMENTS

As it is known, formwork props are currently spread worldwide, because they significantly accelerate the process of construction. However, due to small damages of the formwork props, they become hardly usable or not usable at all. The reason is that if the formwork props, comprised of the sections having a shape of a pipe of larger and smaller diameter, which are inlet one in to the other, according to the telescopic principle, a small dent is formed inside or the inner wall of the prop becomes uneven, thus, the mentioned sections cannot be suitably connected. It is very difficult to repair the formwork prop of this type. Unplanned failures and repair works of this nature are very undesirable, therefore, these used (damaged) props are usually thrown away and the new ones are used instead of them.

This invention is designed for the damaged props of this type to be repaired/restored effectively and fast directly on the site. When using this tool, damaged prop can be restored in a few minutes and then be successfully used during the construction. Moreover, damaged prop barely interferes other works, because the repair requires neither specially arranged place nor electricity source or qualified specialist, who would need to come to the site, or physically strong man hands.

Figure 1:
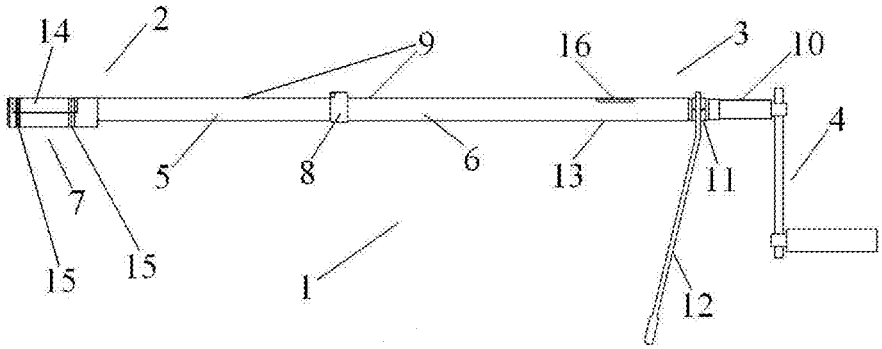
FIG. 1 shows an overall view of a tool structure designed for restoration of the formwork props.
Figure 2:
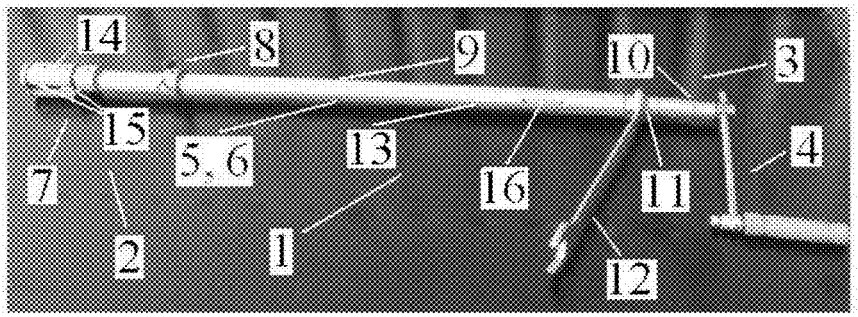
FIG. 2 shows a photograph, which illustrates the structure of the provided tool.

FIG. 1 shows general structure of a tool (device), designed for restoration of formwork props, and the photograph illustrating this instrument is provided in FIG. 2.

Figure 3:
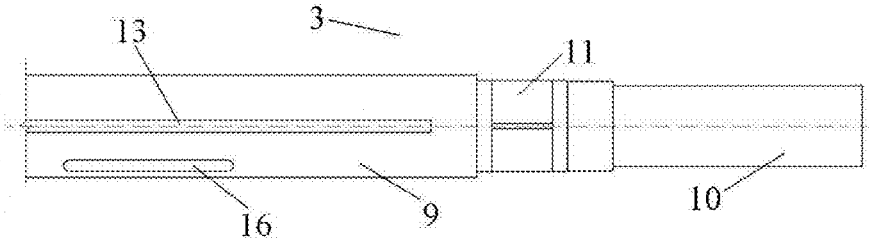
FIG. 3 shows a detailed sectional view of the section of the rotating part of the tool.
Figure 4:
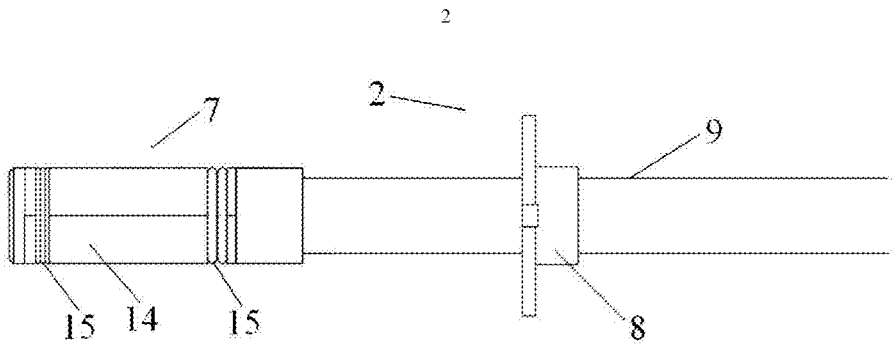
FIG. 4 shows a section of the dilative operational part of the tool in the initial position.
Figure 5:
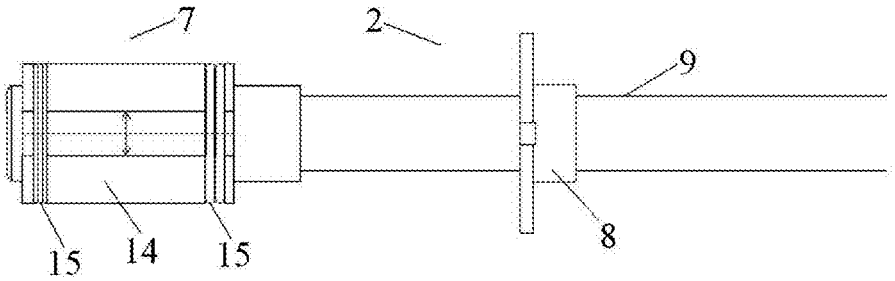
FIG. 5 shows a section of the dilative operational part of the tool in the operational position.

This tool (1) consists of two main sections: dilative (extension) operational part section (2) and rotational part section (3). Both of these sections (2, 3) or their parts are made of hard materials, for example, steel, diamond, metal alloys and etc. FIG. 3 shows more detailed section (3) of the rotational part of the tool, FIG. 4 presents more detailed section (2) of the dilative operational part of the tool, while FIG. 5 presents section (2) of the dilative operational part in the operational position. Section (2) dilative operational part is inlet inside the damaged formwork prop in the place, which is to be repaired. Section (3) of the rotational part consists of a screwdriver (4) and the rotating part (10) based on the screw mechanism. Section (3) of the rotational part is rotated around its axis by a screwdriver (4) clockwise or counterclockwise. Section (2) of the dilative operational part is comprised of one or few connected pipe-shaped elements (5, 6) and a head (7). The mentioned pipe-shaped elements (5, 6) ensure overall lengthening of the tool. The amount of the pipe-shaped elements (5, 6) is not limited. To indicate the depth of the formwork prop to which the section (2) of the dilative (extension) operational part is to be inlet, meter (measurer)—position fixer (8) is used. To achieve this aim, this tool (1) is inserted parallel to or along the formwork prop, which is to be restored, in this way, the head of the tool lies in the place, which is to be repaired. Then, the mentioned meter (8) is put on the tool (1) close to the inlet place to the formwork prop, and, is fixed by using bolted connection. Pipe-shaped elements (5, 6) comprise the stationary part (9) of the tool (1).

When starting to rotate the screwdriver (4) of the tool (1), the rotating part (10) connected to it also starts rotating. For the stationary part (9) not to rotate with the rotating part (10), a bolt (screw) (11) is integrated at the ending of the stationary part (9), which can be held when using the key (12).

Moreover, along the length of the tool (1), small indication groove (13) is drilled, which shows the rotational position of the tool (1) in respect of the surface of the formwork prop. When working with the tool, this groove (13) is to be directed to the side of the damage/dent of the prop which is restored.

When using a screw mechanism, the rotating part (10) is connected with the head (7) of the tool (1), the basis of which consists of: pulled/sliding wedge, integrated into the mentioned screw mechanism; dilative/retractable plate (14), regulated by the mentioned wedge of the head (7); and elastics (15), put on the mentioned dilative/retractable plates (14).

The sequence of the formwork props restoration/repair could be described as follows. In the beginning, when using the meter (8) of the tool, damage depth is indicated. Then, the mentioned meter (8) is fixed on the stationary part (10) of the toll. After that, the dilative operational part section of the tool is inlet inside the formwork prop. The screwdriver (4) of the tool is then rotated. When the screwdriver (4) of the tool is rotating clockwise, the rotational part (10) is rotating in the same direction. The rotational part (10) is connected with the mentioned wedge of the head (7), therefore, when the rotational part (10) is rotating clockwise, the wedge put on the screw mechanism starts moving to the screwdriver (4) of the tool (1). When the screw mechanism starts pulling the wedge of the head (7) to the screwdriver (4) of the tool, the head (7) plates (14) start spreading. In this way, the head (7) of the tool starts spreading, and when this head (7) is spreading inside the formwork prop, it sets the geometry of the formwork prop to the initial position. When the formwork prop is repaired, i.e. restoration is performed, the screwdriver 4) of the tool (1) is rotated backwards, i.e. counterclockwise. When the screwdriver (4) of the tool (1) is rotating counterclockwise, the rotating part (10) of the tool also moves counterclockwise, however, now it not only pulls but also moves the mentioned wedge away, which is integrated in to the head (7) of the tool (1). The moved wedge of the head (7) disengages the head plates (14), which, due to the elastics (15), get back to their initial positions.

To identify the spread level of the head plates (14) of the tool, special extension indicator (16) of the head is used, in which by the red line it is possible to indicated the condition (initial or operational) of the head and the spread of the mentioned head plates (14).

Figure 6:
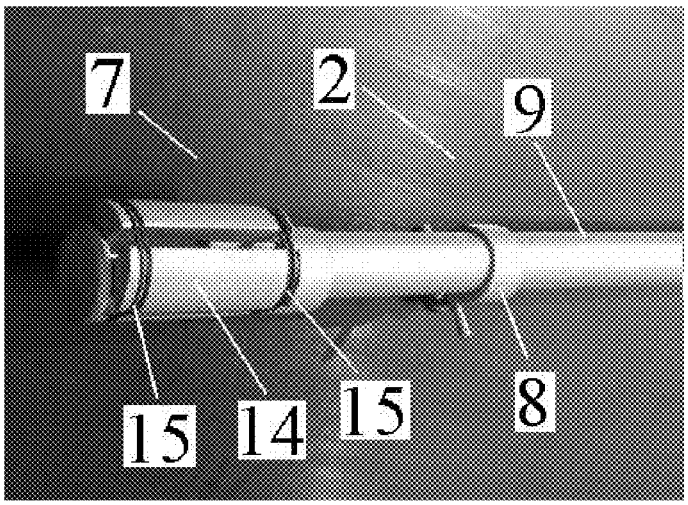
FIG. 6 shows a photograph, which illustrates a section of the dilative operational part of the tool.

FIG. 6 presents a photograph, which illustrates the dilative operational part section (2) of the tool.

The invention claimed is:

1. A tool designed for restoration or repair of at least one of formwork props or construction supports, including a tool housing, control and restoration parts, the tool comprising:

a dilative operational part section, an inlet into a damaged formwork prop close to a location which is to be repaired; and a rotational part section, which is rotated around an axis of the tool clockwise or counterclockwise;

wherein the dilative operational part section includes:

at least two of several connected pipe-shaped elements configured to enable the dilative operational part section to enter into a damaged formwork prop; and extending an overall length of the tool:

a stationary part, functioning as the tool housing;

a bolt screw integrated into an ending of the stationary part and designed for the stationary part not to rotate with the rotational part section using a key attached to the stationary part by the bolt screw;

wherein a head of the tool being designed to restore the geometry of the formwork prop to its initial position opposite a direction from the deformation force;

wherein the rotational part section includes:

a screwdriver designed for clockwise or counter clockwise rotation;

the rotational part section being based on a screw mechanism connected with the screwdriver and, when using the screw mechanism, the rotational part section is connected with a pull/push wedge by the head of the tool;

wherein the head of the tool includes:

the wedge, connected with the screw mechanism of the rotational part section;

at least one of several dilative/retractable plates, which, depending on the rotational direction of the screwdriver, are pushed or pulled by the wedge; and an elastics placed on the at least one of several dilative/retractable plates, the elastics performing the function of returning the at least one of several dilative/retractable plates to the initial position of the at least one of several dilative/retractable plates when the at least one of several dilative/retractable plates are loose, wherein the plates are configured so that, during the restoration of the geometry of the damaged formwork props or construction supports, the plates are expanded not centrically.

2. The tool designed for restoration/repair of the formwork props according to claim 1, wherein the tool parts are made of hard materials.

3. The tool designed for restoration/repair of the formwork props according to claim 1, wherein the overall length of the tool is extended.

4. The tool designed for restoration/repair of the formwork props according to claim 1, wherein the tool includes a meter of a position, designed for indication and fixation of depth, to which the dilative operational part section of the tool is to be inserted.

5. The tool designed for restoration/repair of the formwork props according to claim 4, wherein the tool parts are made of hard materials.

6. The tool designed for restoration/repair of the formwork props according to claim 4, wherein the meter is inserted parallel to or along the formwork prop which is to be restored.

7. The tool designed for restoration/repair of the formwork props according to claim 5, wherein said hard materials are at least one of steel, diamond and metal alloys.

8. The tool designed for restoration/repair of the formwork props according to claim 4, wherein the meter is inserted parallel to or along the formwork prop which is to be restored.

9. The tool designed for restoration/repair of the formwork prop according to claim 1, wherein the tool includes an indication groove, showing a position of the tool relative to the formwork prop surface;

wherein, in operation, the indication groove is directed to a restored damage/dent side of the formwork prop.

10. The tool designed for restoration/repair of the formwork prop according to claim 9, wherein the tool includes a head extension indicator, which is designed for indicating the spread level of the at least one of several dilative/retractable plates.

11. The tool designed for restoration/repair of the formwork props according to claim 9, wherein the tool parts are made of hard materials.

12. The tool designed for restoration/repair of the formwork props according to claim 11, wherein said hard materials are at least one of steel, diamond and metal alloys.

13. The tool designed for restoration/repair of the formwork prop according to claim 1, wherein the tool includes a head extension indicator, which is designed for indicating the spread level of the at least one of several dilative/retractable plates.

14. The tool designed for restoration/repair of the formwork props according to claim 13, wherein the tool parts are made of hard materials.

15. The tool designed for restoration/repair of the formwork props according to claim 14, wherein said hard materials are at least one of steel, diamond and metal alloys.

16. A method designed for restoration/repair of formwork props by using a tool according to claim 4, wherein the method includes:

using the meter fixed on the stationary part, the damage depth is indicated and the meter is fixed on the stationary part;

the dilative operational part section is inserted into the formwork prop close to a location, which is to be restored/repaired;

rotating the screwdriver clockwise until the full restoration/repair of the damaged formwork prop is performed:

wherein, when the screwdriver is rotating clockwise, the rotational part section connected with the screwdriver by using the screw mechanism, is also rotating clockwise;

connecting the rotational part section with the wedge of the tool part during the rotation of the rotational part section, the wedge is moving to the screwdriver;

when the wedge is moving to the screwdriver, the plates, which push and repair/restore geometry of inner walls of the formwork prop, are spreading;

when using the head extension indicator, the spread level of the at least one of several dilative/retractable plates is indicated;

rotating the screwdriver is rotated counterclockwise until the head plates are loose and are returned to their initial position; and formwork prop.

17. The method designed for restoration/repair of formwork props by using the tool according to claim 4, wherein the method includes:

indicating damage depth by using the meter and fixing the meter on the stationary part, inserting the dilative operational part section into the formwork prop close to a location, which is to be restored/repaired;

rotating the screwdriver clockwise until the full restoration/repair of the damaged formwork prop is performed;

wherein when the screwdriver is rotating clockwise, the rotational part section is connected with the screwdriver by using the screw mechanism, and the rotational part section is also rotating clockwise; and further wherein the rotational part section is connected with the wedge, and during the rotation of the rotational part section, the wedge is moving to the screwdriver;

when the wedge is moving to the screwdriver, the plates which push and repair/restore geometry of inner walls of the formwork prop, are spreading;

controlling the spread level of the at least one of several dilative/retractable plates using the head extension indicator, rotating the screwdriver counterclockwise until the at least one of several dilative/retractable plates are loose and returned to their initial position;

and pulling the dilative operational part section out from the formwork prop.

18. The method designed for restoration/repair of formwork props by using the tool according to claim 4, wherein the method includes:

using the meter to indicate the damage depth and fixing the meter on the stationary part;

inserting the dilative operational part section into the formwork prop close to a location, which is to be restored/repaired;

rotating the screwdriver clockwise until the full restoration/repair of the damaged formwork prop is performed, wherein, when the screwdriver is rotating clockwise, the rotational part section connected with the screwdriver by the screw mechanism, is also rotating clockwise, when the rotational part section is connected with the wedge, during rotation of the rotational part section, the wedge is moving to the screwdriver; and when the wedge is moving to the screwdriver, the at least one of several dilative/retractable plates, which push and repair/restore geometry of inner walls of the formwork prop, are spreading;

controlling the spread level of the least one of several dilative/retractable plates when using the head extension indicator;

rotating the screwdriver counterclockwise until the at least one of several dilative/retractable plates are loose and returned to their initial position;

and pulling the dilative operational part section out from the formwork prop.

19. The method designed for restoration/repair of formwork props by using a tool according to claim 4, wherein the method includes:

using the meter to indicate damage depth and securing the meter on the stationary part;

inserting the dilative operational part section into the formwork prop close to a location, which is to be restored/repaired;

rotating the screwdriver clockwise until the full restoration/repair of the damaged formwork prop is performed;

wherein when the screwdriver is rotating clockwise, the rotational part section connected with the screwdriver by using the screw mechanism, is also rotating clockwise;

when the rotational part section is connected with the wedge during rotation of the rotational part section the wedge is moving to the screwdriver;

when the wedge is moving to the screwdriver the at least one of the several dilative/retractable plates, which push and repair/restore geometry of inner walls of the formwork prop, are spreading; and controlling the spread level of the at least one of several dilative/retractable plates when using the head extension indicator;

rotating the screwdriver counterclockwise until the at least one of several dilative/retractable plates are loose and returned to their initial position; and pulling the dilative operational part section out from the formwork prop.

20. A method designed for restoration/repair of formwork props by using a tool according to claim 13, wherein the method includes:

using a to meter to indicate damage depth and fixing the meter on the stationary part;

inserting the dilative operational part section into the formwork prop close to a location which is to be restored/repaired;

rotating clockwise the screwdriver until the full restoration/repair of the damaged formwork prop is performed;

such that when the screwdriver is rotating clockwise, the rotational part section connected with the screwdriver using the screw mechanism, is also rotating clockwise;

connecting the rotational part section of the tool with the wedge of the tool head, during rotation of the rotational part section so that the wedge is moving to the screwdriver;

wherein, when the wedge is moving to the screwdriver, the plates, are spreading;

controlling spread level of the plates using the head extension indicator;

rotating the tool screwdriver counterclockwise until the at least one of several dilative/retractable plates are loose and are returned to their initial position; and pulling the dilative operational part section out from the formwork prop.

* * * * *